US010245803B2

(12) United States Patent
Clark et al.

(10) Patent No.: US 10,245,803 B2
(45) Date of Patent: Apr. 2, 2019

(54) APPARATUS, SYSTEM AND METHOD FOR CUTTING AND CREASING MEDIA

(71) Applicant: Xerox Corporation, Norwalk, CT (US)

(72) Inventors: Robert A. Clark, Williamson, NY (US); William J. Nowak, Webster, NY (US); William J. Hannaway, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 954 days.

(21) Appl. No.: 13/800,555

(22) Filed: Mar. 13, 2013

(65) Prior Publication Data

US 2014/0274643 A1 Sep. 18, 2014

(51) Int. Cl.

| | |
|---|---|
| ***B31F 7/00*** | (2006.01) |
| ***B26D 5/06*** | (2006.01) |
| ***B26D 5/08*** | (2006.01) |
| ***B26D 5/32*** | (2006.01) |
| ***B26D 7/20*** | (2006.01) |
| ***B26D 7/27*** | (2006.01) |
| ***B31F 1/08*** | (2006.01) |

(52) U.S. Cl.

CPC ..... *B31F 7/00* (2013.01); *B26D 5/06* (2013.01); *B26D 5/086* (2013.01); *B26D 5/32* (2013.01); *B26D 7/20* (2013.01); *B26D 7/27* (2013.01); *B31F 1/08* (2013.01)

(58) Field of Classification Search

CPC ..... B31F 7/00; B31F 1/08; B26D 7/20; B26D 7/27; B26D 5/06; B26D 5/32; B31B 1/22; B31B 2201/147

USPC ..... 493/51, 59; 400/621; 347/104; 700/134; 29/561, 562

See application file for complete search history.

(56) References Cited

U.S. PATENT DOCUMENTS

| | | | | |
|---|---|---|---|---|
| 357,583 | A * | 2/1887 | Daniels | 493/355 |
| 2,225,630 | A * | 12/1940 | Gilbert | B31B 1/25 493/372 |
| 3,142,233 | A * | 7/1964 | Downie | B26F 1/44 493/324 |
| 3,203,288 | A * | 8/1965 | Blumer | B21D 43/028 83/313 |
| 3,225,667 | A * | 12/1965 | Fuchs | B31B 1/32 493/164 |

(Continued)

FOREIGN PATENT DOCUMENTS

| | | | | |
|---|---|---|---|---|
| EP | 0351223 | A1 * | 1/1990 | B26D 3/085 |

OTHER PUBLICATIONS

U.S. Appl. No. 13/442,268, filed Apr. 9, 2012; Hoover et al.

(Continued)

*Primary Examiner* — Alexander M Valvis
*Assistant Examiner* — Lucas E. A. Palmer
(74) *Attorney, Agent, or Firm* — Alix, Yale & Ristas, LLP

(57) ABSTRACT

An apparatus is disclosed that includes a computer operated cutting and creasing tool configured to move only in an X direction during use, a cutting and creasing platform having an elastically deformable creasing portion configured to support a sheet of media during contact with a creasing tip and a non-deformable cutting portion configured to support the sheet during contact with a cutting blade, and a positioner configured to draw the sheet of media along the cutting and creasing platform during cutting and creasing. Methods of making and using the apparatus also are disclosed.

16 Claims, 10 Drawing Sheets

(56) References Cited

U.S. PATENT DOCUMENTS 3,274,047 A * 9/1966 Sloan ..... B29C 53/06 229/930
3,407,498 A 10/1968 Young
3,735,660 A * 5/1973 Pearl ..... B26F 1/382 83/374
3,866,901 A 2/1975 Brock
3,942,411 A * 3/1976 Gerber ..... B23Q 1/032 409/137
4,042,939 A 8/1977 Lloyd et al.
4,064,206 A * 12/1977 Seufert ..... B29C 53/06 220/837
4,199,863 A 4/1980 Deckert
4,368,881 A 1/1983 Landa
4,415,515 A * 11/1983 Rosenberg ..... B26D 3/085 264/68
4,447,479 A * 5/1984 Harrison ..... B29C 47/0004 229/100
4,640,222 A * 2/1987 Gerber ..... A41H 23/00 118/308
4,642,086 A * 2/1987 Howarth, Jr. ..... B29C 53/06 425/296
4,732,069 A 3/1988 Wood et al.
4,818,461 A * 4/1989 Batson ..... B26D 3/08 264/156
4,877,391 A * 10/1989 Batson ..... B26D 3/08 220/270
4,920,495 A 4/1990 Pilkington
4,995,287 A 2/1991 Nasu
4,996,651 A 2/1991 Wells
5,011,093 A 4/1991 Mayer et al.
5,060,880 A 10/1991 Mayer
5,188,009 A 2/1993 Sunohara et al.
5,264,904 A 11/1993 Audi et al.
5,275,077 A 1/1994 Kobayashi
5,294,069 A 3/1994 Blahnik
5,296,872 A * 3/1994 Caamano ..... 220/270
5,321,892 A 6/1994 Sasada
5,435,538 A 7/1995 Billings et al.
5,443,194 A 8/1995 Takahashi
5,509,885 A * 4/1996 Brunlid ..... B26D 7/27 346/24
5,624,369 A * 4/1997 Bidlack ..... B31F 1/08 493/160
5,671,647 A 9/1997 Mori
5,861,077 A 1/1999 Kamijo et al.
5,937,725 A 8/1999 Kamijo et al.
5,964,686 A * 10/1999 Bidlack ..... B31B 1/16 493/342
6,112,630 A * 9/2000 Miura ..... B26D 1/185 493/160
6,189,414 B1 2/2001 Yoshizawa et al.
6,190,297 B1 * 2/2001 Croft ..... B26D 5/00 700/114
6,582,348 B2 * 6/2003 Bacciottini ..... B26D 7/20 493/353
6,616,360 B2 9/2003 Lehmkuhl
6,664,995 B2 12/2003 Milton et al.
6,694,628 B2 2/2004 Kojima et al.
6,807,888 B1 * 10/2004 Kiyohara ..... B26D 1/045 346/24
6,814,517 B2 11/2004 Fisher et al.
6,926,400 B2 * 8/2005 Kelley ..... B23D 35/008 400/621
6,945,645 B2 9/2005 Baron
7,153,066 B2 12/2006 Schafer et al.
7,559,549 B2 7/2009 Clark et al.
7,588,245 B2 9/2009 Mandel et al.
7,731,188 B2 6/2010 deJong et al.
7,746,524 B2 6/2010 Lofthus et al.
7,789,484 B2 * 9/2010 Takada ..... B26F 1/3806 347/37
7,930,958 B2 * 4/2011 Workman ..... B26D 7/2628 30/161
7,934,718 B2 5/2011 Clark
8,056,897 B2 11/2011 deJong et al.
8,146,472 B2 4/2012 Nishimura et al.
8,636,431 B2 * 1/2014 Crystal ..... B41J 3/4073 400/595
2003/0206211 A1 * 11/2003 Baron ..... B31F 1/10 271/10.01
2003/0230843 A1 12/2003 Clark
2004/0094003 A1 * 5/2004 Bar-Erez ..... B41J 11/663 347/37
2004/0161279 A1 * 8/2004 Tseng ..... B23P 15/00 83/13
2005/0186010 A1 * 8/2005 Shibata ..... B26D 7/015 400/621
2005/0268469 A1 12/2005 Fritz
2006/0090621 A1 5/2006 Shimizu
2006/0117922 A1 * 6/2006 Causse ..... B26D 5/00 83/76.3
2006/0257014 A1 11/2006 Oi
2007/0227332 A1 * 10/2007 Causse ..... B41J 11/666 346/24
2007/0261529 A1 11/2007 Schulz
2010/0058943 A1 3/2010 Bober
2011/0052301 A1 * 3/2011 Crystal ..... B41J 3/4073 400/621
2011/0148994 A1 6/2011 Lin et al.
2011/0152048 A1 6/2011 Gombert et al.
2011/0283849 A1 * 11/2011 Takizawa ..... B26D 5/005 83/13
2012/0103154 A1 * 5/2012 Okabe ..... B23C 1/007 83/72
2012/0247642 A1 * 10/2012 Bartholomeusz .... B26D 7/2628 156/64
2013/0017940 A1 * 1/2013 Bonariva ..... B31B 1/20 493/59
2013/0028648 A1 1/2013 Dufort
2013/0045847 A1 * 2/2013 Capoia ..... B26D 7/2635 493/59
2013/0266358 A1 * 10/2013 Nowak ..... B65H 7/20 400/621
2013/0267397 A1 * 10/2013 Hoover ..... B31B 1/00 493/17
2014/0150618 A1 * 6/2014 Fujihara ..... B26D 7/2614 83/401
2014/0150619 A1 * 6/2014 Fujihara ..... B26F 1/3813 83/401
2015/0174850 A1 * 6/2015 McMahon ..... B31B 45/00 493/59

OTHER PUBLICATIONS

U.S. Appl. No. 13/439,369, filed Apr. 4, 2012; Nowak et al.
Craft ROBO Pro, User's Manual, Manual No. CE50CRP-UM-152 (undated) 13 pages.

* cited by examiner

APPARATUS, SYSTEM AND METHOD FOR CUTTING AND CREASING MEDIA

BACKGROUND

The embodiments disclosed herein generally relate to a platform, system and method for converting media using a digital cutting and creasing device.

An X-theta cutter is similar to a pen plotter with the exception that a cutting blade is used instead of a pen. A sheet of media, such as vinyl, paper, or other material, is moved back and forth in the process direction by a knurled roll/idler combination. Movement in the cross process direction is accomplished by moving the cutting blade via a carriage. Backing on the opposite side of the sheet from the cutting blade is typically formed from a polytetrafluoroethylene (ptfe) strip or other soft sacrificial material on top of a flat sheet-metal cutting surface. Without that sacrificial ptfe layer, the cutting blade would contact the sheet metal cutting surface when cutting all the way through the media, thereby damaging or at least dulling and reducing the life of the cutting blade. The strip abrades with use and needs to be replaced quite frequently. One solution to this problem is to temporarily attach a plastic backing sheet to the media that will be cut. However, this is a time consuming process, requires some skill on the part of the operator, and would add additional material for the cutting knife to come in contact with, causing additional loss of cutting knife life. In addition, a plastic backing sheet would also seriously compromise the auto feeding capability of the digital cutter.

Current plotter based media cutters are capable of cutting and/or marking a sheet of media. However, if an operator wants to crease a sheet of media to facilitate the folding needed to form a media structure, a more expensive X-Y cutting table is required. The cutting surface on an X-Y cutting table is usually a medium density elastomer, which affords sufficient compliance such that a creasing tool can plastically deform the sheet into the cutting surface, thereby forming a crease.

It would be useful to develop a plotter-type system that is capable of both cutting and creasing media without requiring the use of a sacrificial strip or a backing sheet during the cutting process.

SUMMARY

One embodiment described herein is an apparatus for cutting and creasing sheets of media. The apparatus comprises a cutting and creasing tool, a cutting and creasing platform, a positioner and a computerized processor. The cutting and creasing tool, which is configured to move only in an X direction during use, includes a non-rotatable cutting blade, and a non-rotatable creasing tip spaced from the cutting blade. The cutting and creasing tool includes a cut-crease head that is configured to support only one cutting blade and only one creasing tip during use. The cutting and creasing platform has an elastically deformable creasing portion configured to support a sheet of media during contact with the creasing tip, and a non-deformable cutting portion configured to support the sheet during contact with the cutting blade. The cutting portion has an elongated channel formed therein to receive the cutting blade during cutting. The positioner is configured to draw the sheet of media along the cutting and creasing platform in a Y-direction while shifting the sheet back and forth along the Y-direction in response to at least one of a cutting order and a creasing order. The computerized processor is configured to operate the cutting and creasing tool and the positioner. A method of cutting and creasing a sheet of media using the apparatus is also described.

Another embodiment is a system for cutting and creasing sheets of media that includes automatic in-feed and out-feed. The system includes a cutting and creasing tool, a cutting and creasing platform, a positioner, a computerized processor, and first feeder and a second feeder. The first feeder is disposed adjacent to or is connected to the cutting and creasing platform, and is configured to automatically transport individual sheets of media from an in-feed receptacle toward the cutting and creasing platform using a first feed device. The second feeder is disposed adjacent to or is connected to the cutting and creasing platform, and is configured to automatically transport individual sheets of media from the cutting and creasing platform to an out-feed receptacle after at least one of cutting and creasing.

Yet another embodiment described herein is a method of making a media converter, including forming a cutting and creasing tool and a cutting and creasing platform, and mounting the tool above the platform. A positioner is formed that is configured to draw the sheet of media along the cutting and creasing platform in a Y-direction while shifting the sheet back and forth along the Y-direction in response to at least one of a cutting order and a creasing order, and a computerized processor is formed to operate the cutting and creasing tool and the positioner.

DETAILED DESCRIPTION

Figure 1:
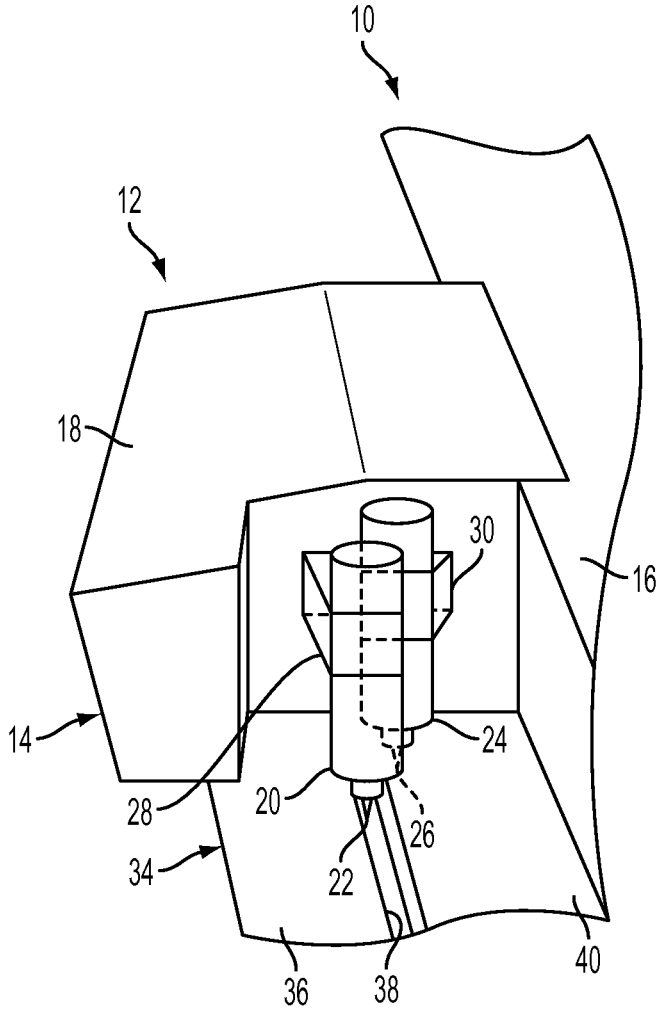
FIG. 1 is a perspective view of a portion of a media cutting and creasing device according to one embodiment.

As used herein, "cutting platform" refers to the horizontal, inclined, flat or non-flat surface in the cutting and creasing device where the media is positioned during cutting. "Creasing platform" refers to the horizontal, inclined, flat or non-flat surface in the cutting and creasing device where the media is positioned during creasing. "Cutting and creasing platform" refers to a dual hardness working surface for performing cutting and creasing in the device. "Non-deformable portion" refers to a portion of the platform than cannot be elastically or inelastically deformed by pressure applied by a tool in a media cutting and creasing device. "Elastically deformable portion" refers to a portion of the platform that can be elastically deformed by pressure applied by a creasing tool in a media cutting and creasing device. A "media converter" as used herein is a device that can be used to cut and crease media.

"Dimensional document" refers to a three-dimensional object formed by cutting and folding a flat sheet of media. In most cases, the dimensional document has printed matter, such as text and images disposed on the surface thereof (or in some cases has a uniform pigmented or dyed color). "Media" refer to any sheet-shaped stock, such as paper, cardboard, paper board, vinyl, labels, polyester, etc. that may be formed into a dimensional document. "Cut" means to cut and/or score. A "cutting and creasing device" is a device used to digitally cut and crease media. "Crease" means to impart a crease without cutting the media. A "feeder" as used herein refers to an apparatus that feeds media. "Feed device" as used herein refers to a feed roll or rolls, or a vacuum feed device. "Retard feed technology" refers to various techniques for accurately separating and feeding sheets using a feed roll and a retard roll or pad. "Vacuum feed technology" refers to various techniques for moving a sheet through a feed path using a vacuum.

The embodiments described herein include an automatic feed media cutting and creasing device that will enable profitable production of small volumes of media structures, including dimensional documents such as boxes. Typically, boxes are cut from sheets using relatively expensive die-cutting equipment. This cost inhibits the ability to accommodate small orders. In contrast, the system described herein uses a cutting and creasing device having a design that is similar to pen plotters that were in wide use in the 1980s, except that the cutting-creasing plotters use cutting blades and creasing tips instead of pens. This type of cutting-creasing plotter typically uses a knurled or partially knurled shaft and idlers to maintain control of the sheet and move the sheet back and forth in the process direction, referred to herein as a Y-direction, during a cut-crease job. The other axis is accommodated via a belt or cable driven carriage upon which a blade and tip assembly is mounted. In embodiments, the blade-tip assembly includes a solenoid-based mechanism that lowers the cutting blade or creasing tip against the sheet when a cut or crease is to be made. In embodiments, a return spring lifts the blade away from the sheet once the solenoid is de-energized. The control of both axes and the solenoid can be dictated by a cut-crease file which is generated by a computer application and downloaded to the cutting and creasing device.

One embodiment described herein is a media converter which includes a cutting surface or platform that combines a hard, channeled section for cutting, and an elastically deformable creasing surface or platform that is sufficiently compliant for creasing. In embodiments, the two surfaces are placed side-by-side, and are used in conjunction with a cutting and creasing device that includes separate cutting and creasing tools. This arrangement provides for both cutting and creasing on an X-theta cutter at a significantly lower cost than if an X-Y cutting table were used.

Referring to FIGS. 1-3, a dual-head creaser/cutter with X-theta cutting architecture is shown. In embodiments, folds are facilitated by creasing the media along the line of the desired fold, without cutting the media. In one embodiment, a cutting head accommodates two different tools actuated by two different solenoid systems. The solenoids can be actuated independently from one another. For a converting job that involves both cutting and creasing, the cutting tool will be placed in a first station, shown as the downstream station in FIG. 1, and the creasing tool will be placed in a second station, shown as the upstream station in FIG. 1. In some embodiments, the second station is actuated by two solenoids, whereas the first station is actuated by a single solenoid. This arrangement doubles the available tool force at the second station, which is necessary for creasing heavy-weight media.

Referring more specifically to the drawings, FIG. 1 schematically shows a perspective view of a portion of cutting and creasing device 10 in accordance with a first embodiment, showing details of the cutting and creasing tools. The cutting and creasing device 10 includes a cut-crease mechanism 12 having a cut-crease head 14 with a cover 18. The cut-crease head 14 is mounted to a capstan 16, which moves the cut-crease head 14 in the cross-flow direction. The cut-crease head 14 includes a cutting tool 20 having a cutting blade 22, and a creasing tool 24 having a creasing tip 26. The cutting tool 20 is supported within the cut-crease head 14 by a cutting tool arm 28, and the creasing tool 24 is supported within the cut-crease head 14 by a creasing tool arm 30. The creasing tool 24 is slightly spaced from the cutting tool in both the Y direction (flow direction) and also in the X direction. In embodiments, the vertical axis of the cutting tool is spaced from the vertical axis of the creasing tool by about 5-20 mm (wide range) or 8-15 (narrower range) in the Y direction (process direction) and about 25-40 mm (wide range) or 30-35 (narrower range) in the X direction, with the cutting tool being slightly downstream from the creasing tool. In embodiments, the cutting tool and creasing tool are solenoid-operated, however, other means of operation that provide for vertical movement of the cutting blade 22 and creasing tip 26 also can be used.

A dual surface cutting and creasing platform 34, shown in FIGS. 1-3, is disposed beneath the cut-crease mechanism 12. While the platform is horizontally disposed in the embodiment shown, other configurations, including an incline, can be used. The cutting and creasing platform 34 includes a rigid portion 36 having a cutting channel 38 formed therein defined by opposite side walls 43 and 45, and lower wall 47. The channel 38 extends in an X direction which is perpendicular to the media flow direction (Y direction). The cutting and creasing platform also includes an elastically deformable portion 40 disposed adjacent to, and upstream from, the rigid portion 36. The elastically deformable portion has sufficient compliance in order that the creasing tool can plastically deform and crease the media as it generates a fold line without cutting the media. In embodiments, the upper surface of the creasing section is generally co-planar with the upper surface of the cutting section. The creasing surface of the creasing section (or, simply the creasing section)

typically has a Shore A hardness in the range of 40-90 (wide), or 50-75 (intermediate or 60-70 (narrow).

The channel 38 in the rigid portion 36 of the platform 34 is sized and configured to receive a portion of the cutting blade 22 when the cutting blade 22 engages a sheet of media and the blade 22 traverses along the length of walls 43, 45 and 47 of the channel 38. The cutting and creasing platform is stationary and the cutting blade 22 and creasing tip 26 move relative to the channel 38 in the plan of the sheet of media. The rigid portion 36 can include multiple cutting channels, either aligned next to one another in a generally parallel arrangement, or aligned in an alternating configuration with an elastically deformable portions disposed between adjacent grooves. The channel can have any suitable shape, and typically has a rectangular-shaped, V-shaped, or hybrid V-and-rectangular-shaped cross section. Non-limiting examples of suitable configurations of channel shape are shown in co-pending application Ser. No. 13/443,978 filed Apr. 11, 2012, the contents of which are incorporated herein by reference in their entirety.

Figure 2A:
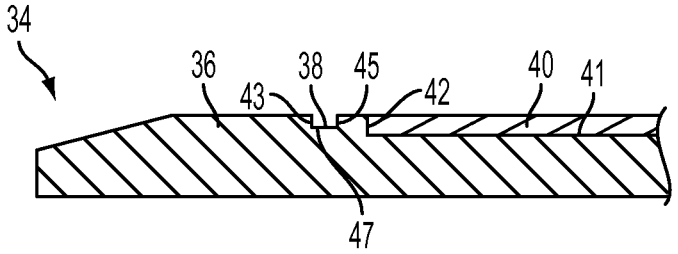
FIGS. 2A-2D depict schematic sectional views of various embodiments of the working platform used in the device of FIG. 1.
Figure 3A:
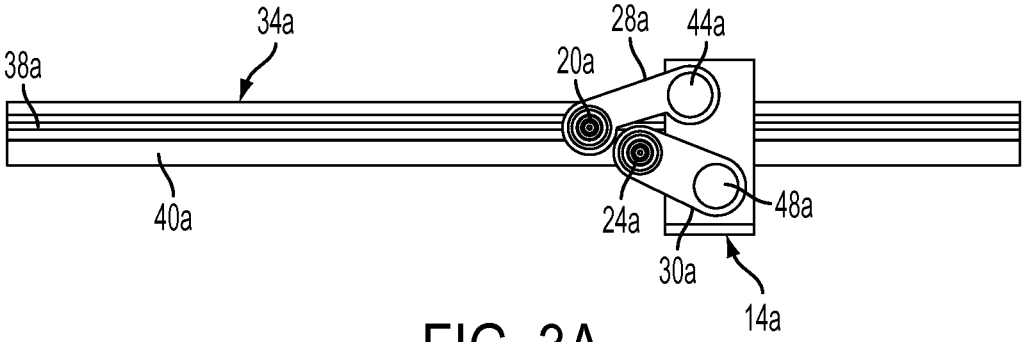
FIG. 3A is a schematic plan view of one embodiment of the media cutting and creasing device shown in FIG. 1, with the cutting and creasing head cover removed.

In the embodiment shown in FIG. 2A, the elastically deformable portion 40 is mounted in an opening in the rigid portion 36, the opening being defined by lower wall 41, side wall 42, and an opposite side wall (not shown). In some cases, the elastically deformable portion 40 is removably mounted, allowing for interchange with elastically deformable portions 40 having various amounts of deformability. In other cases, the elastically deformable portion 40 is fixed to the rigid portion 36.

Figure 2B:
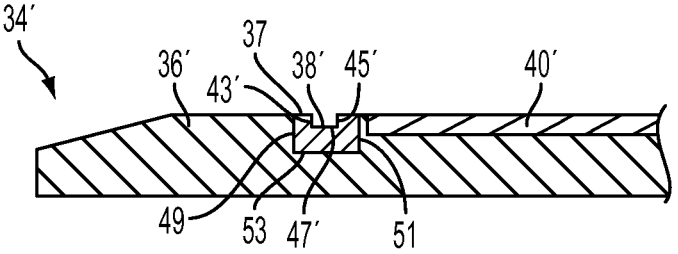

In the embodiment of FIG. 2B, which depicts platform 34', rigid portion 36' and elastically deformable portion 40', a rigid, removable insert 37 forms the walls 43', 45' and 47' of the channel 38'. The insert 37 is removably mounted in an opening in the rigid portion 36' that is defined by side walls 49 and 51, and lower wall 53. Use of an insert 37 enables the geometry, including size and/or shape, of the channel to be changed by selecting various inserts 37.

Figure 2C:
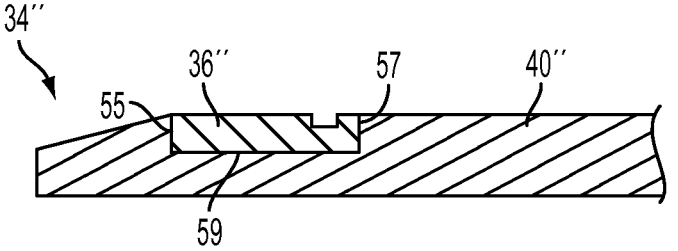

In the embodiment of FIG. 2C, which depicts platform 34", the rigid portion 36" is removably or fixedly mounted in an opening in the elastically deformable portion 40" that is defined by side walls 55 and 57, and lower wall 59. This configuration is feasible in embodiments in which the elastically deformable portion is not too soft.

Figure 2D:
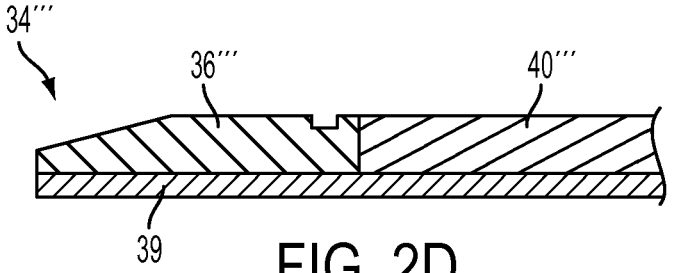

In the embodiment of FIG. 2D, which depicts platform 34", the elastically deformable portion 40''' and the rigid portion 36''' are removably or fixedly mounted side-by-side on a base 39.

In embodiments, the elastically deformable portion is downstream from the rigid portion. This configuration can be used when the sheets are sufficiently stiff so as to avoid out-of-plane buckling of the sheet.

The rigid portion 36 of the cutting and creasing platform 34 typically is made of a hard material, such as metal, including without limitation aluminum and steel, which can be coated with a non-stick material, such as ptfe or the like, or is made of a hard thermoplastic or thermoset material, or a composite of a metal and a thermoplastic or thermoset material. In embodiments, the dimensions of the cutting portion of the cutting platform are 0.5 cm-2 cm, or about 1 cm in width and 40-55 cm, or about 48 cm in length.

The elastically deformable portion 40 of the platform 34 typically is made of an elastically deformable thermoplastic or thermoset material, such as polyurethane, polyolefin, rubber or epoxy, or the like. The type of media to be cut can be paper, plastic, textile or rubber, but usually is paper or plastic.

One suitable type of configuration for operating the cutting and creasing tools is shown in FIGS. 3A, 3B, 4A and 4B. In these embodiments, the tools are moved vertically upward and downward using solenoids. The solenoids include metallic windings (usually but not necessarily copper). More specifically, in the embodiment of FIGS. 3A and 4A, a first solenoid 44*a* and a first spring 46*a* are mounted in the cut-crease head 14*a* and are connected to the cutting tool 20*a* by cutting tool arm 28*a*. A second solenoid 48*a* and a second spring (not shown) are mounted in the cut-crease head 14*a* and are connected to the creasing tool 24*a* by creasing tool arm 30*a*. Similar to the embodiment shown in FIG. 1, the cutting tool 20*a* has a blade point at the tip, whereas the creasing tool 24*a* has a ball point at the tip. Both the cutting tool and the creasing tool are movable between an engaged position and a non-engaged position. The cutting blade 22 (see FIG. 1) engages the sheet of media and extends into channel 38*a* when the first solenoid 44*a* is energized to extend the cutting blade (22). The cutting blade (22) disengages when the first solenoid 44*a* is de-energized and the first spring 46*a* retracts the cutting blade (22) from the sheet of media on the cutting and creasing platform 34*a*. The creasing tip (26) (see FIG. 1) engages the sheet of media to crease but not cut when the second solenoid 48*a* is energized to extend the creasing tip (22) toward the creasing portion 40*a* of the cutting and creasing platform 34*a*. The creasing tip (26) disengages when the second solenoid 48*a* is de-energized and the second spring retracts the creasing tip (26) from the sheet of media on the cutting and creasing platform 34*a*. In the embodiment shown in FIGS. 3A and 4A, the solenoids are actuated independently from one another.

Figure 3B:
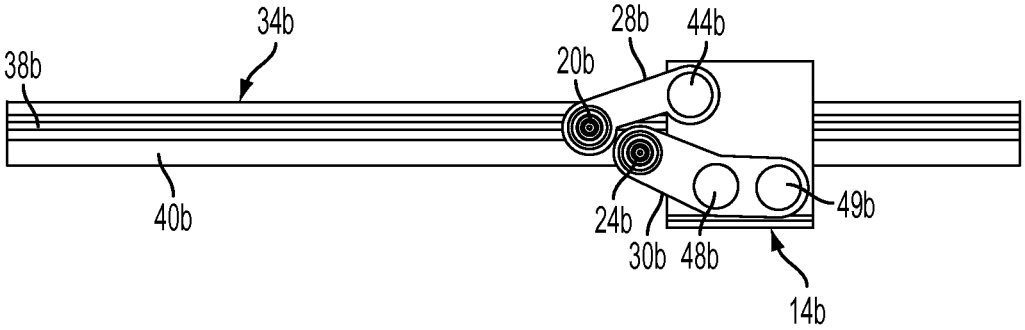
FIG. 3B is a schematic plan view of another embodiment of the media cutting and creasing device shown in FIG. 1, with the cutting and creasing head cover removed.
Figure 4A:
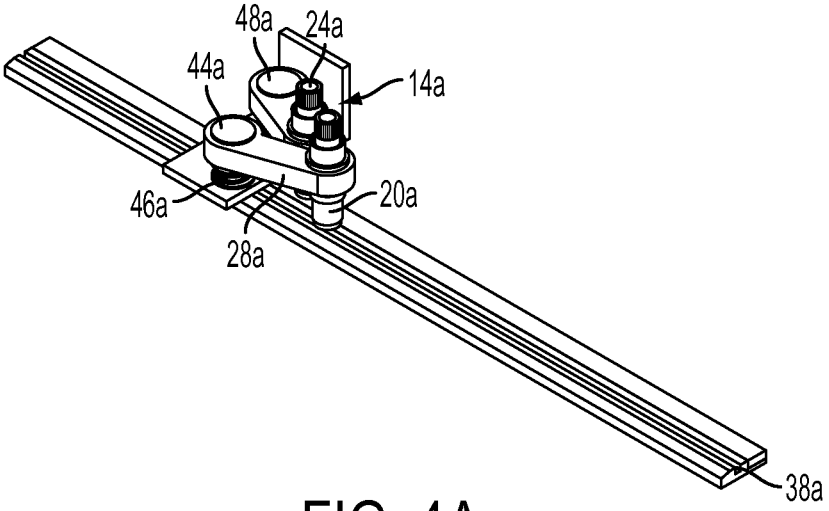
FIG. 4A is a perspective view of the solenoid embodiment of FIG. 3A, with the cover removed.
Figure 4B:
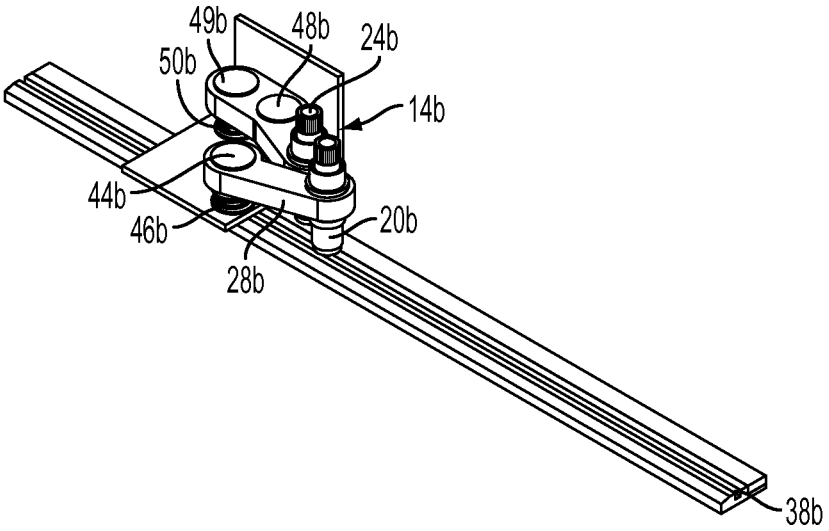
FIG. 4B is a perspective view of the solenoid embodiment of FIG. 3B, with the cover removed.

In an alternative embodiment, shown in FIGS. 3B and 4B, one solenoid is activated for cutting, but two solenoids are activated for creasing, as additional tool force is needed for creasing heavyweight media. In this embodiment, the cutting blade 22 (see FIG. 1) is actuated in generally the same manner as is described above in connection with FIG. 3A, i.e. using the first solenoid 44*b* and first spring 46*b*. The cut-crease head 14*b* includes the cutting tool 20*b* and creasing tool 24*b*, which are adjacent one another. The cutting tool 20*b* is connected to the first solenoid 44*b* by cutting tool arm 28*b*. The creasing tool 24*b* is connected to the second solenoid 48*b* and the third solenoid 49*b* by creasing tool arm 30*b*. The cutting blade 22 (see FIG. 1) extends into channel 38*b* during cutting. The creasing tip 26 (see FIG. 1) engages the sheet of media to crease but not cut when both the second solenoid 48*b* and a third solenoid 49*b* are energized to extend the creasing tip 26 toward the creasing portion 40*b* of the cutting and creasing platform 34*b*. The creasing tip 26 disengages when the second solenoid 48*b* and the third solenoid 49*b* are de-energized, and the second spring and third spring 50*b* retract the creasing tip 26 from the sheet of media on the cutting and creasing platform 34*b*.

In embodiments, the cutting and creasing device is incorporated into an X-theta cutting and creasing device with automatic in-feed and out-feed. The cutting and creasing device 10 comprises a chassis, a motor and the carriage operably secured to the chassis and driven by the motor for reciprocal movement relative to the chassis. As indicated above, typically, the cut-crease head 14 traverses in an X-direction via a capstan drive. Movement of a sheet of media in the process direction, i.e. the Y-direction, is enabled by moving the media via a drive roll. The cutting plate has at least one channel providing clearance for the blade as it is lowered to cut media.

To operate the cutting and creasing device, when a cut is to be made, the capstan and media drive work together to locate the cutting tool at the start point, at which time the cutting tool solenoid is energized and the cutting tool is pressed down against the media (usually into a channel 38). The media is then cut according to the previously programmed path. The sheet of media is moved back and forth in the Y direction during cutting using the drive roll. At the end of the cutting operation, the solenoid is de-energized and a return spring (not shown) retracts the tool from the media.

When a crease is to be made, as indicated above, the process is similar except that it is the creasing tool that is pressed against the media by energizing the solenoid attached to the creasing tool. The media deforms into the compliant section, and a crease is made as both the creasing head and media move along a previously programmed path. At the end of the crease, the solenoid is de-energized and a return spring (not shown) retracts the tool from the media.

The primary difference between the cutting blade 22 and the creasing tip 26 is the sharpness In embodiments, the cutting blade has a sharpened edge, while the creasing tool has a ball-point tip. The creasing tip usually requires a substantially higher applied force than the cutting blade in order to plastically deform (i.e. crease) the sheet.

Figure 5:
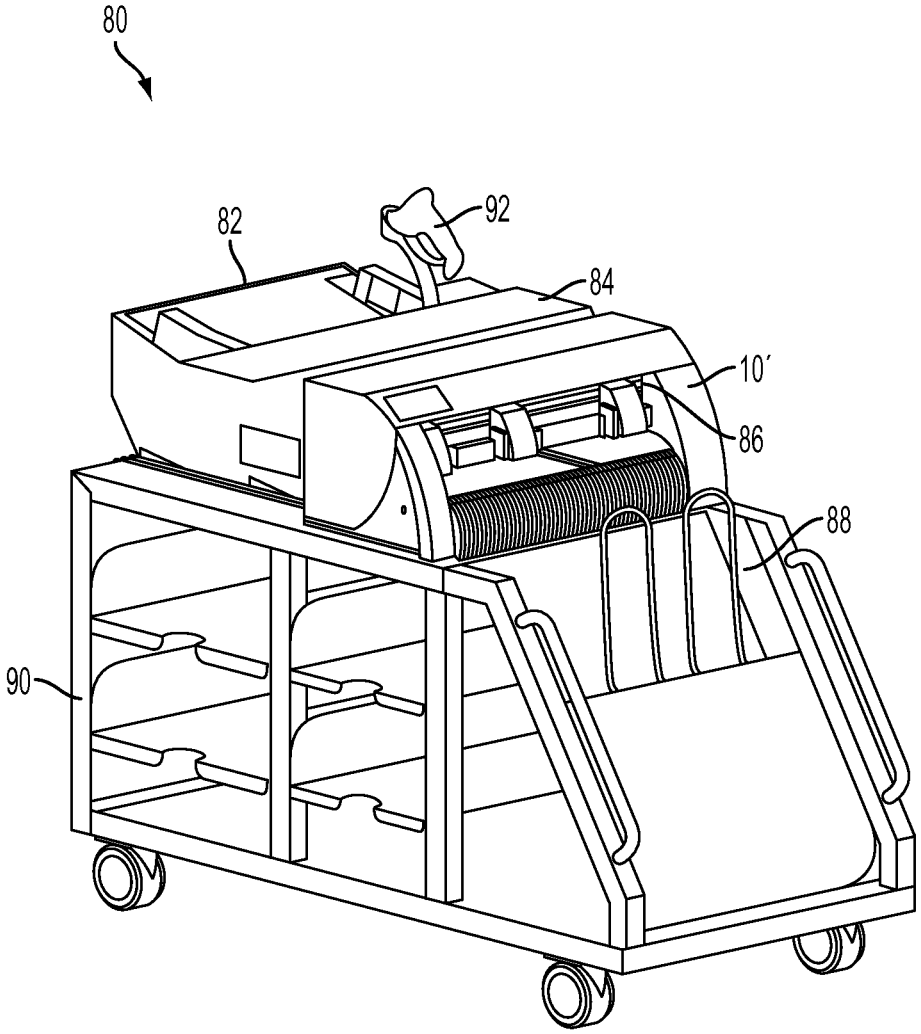
FIG. 5 is a perspective view of a media cutting, creasing and feeding system according to one embodiment.

FIG. 5 schematically illustrates an automatic feed cutting and creasing system for producing dimensional documents which can incorporate a cutting and creasing device of the type shown in FIGS. 1-3. The cutting and creasing system, which is designated generally as 80, includes an in-feed receptacle 82, an automatic in-feeder 84, a cutting and creasing device 10', an automatic out-feeder 86, which, in the embodiment of FIG. 5, is disposed inside the cutting and creasing device, and an output receptacle 88. The in-feed receptacle 82 is configured to hold a media stack that includes a plurality of sheets. The in-feeder 84 usually is configured to transport sheets individually to the cutting and creasing device 10. In the embodiment shown in FIG. 5, the cutting and creasing system 80 is mounted on a cart 90, but a table or other mounting surface also can be used.

The embodiment shown in FIG. 5 includes a sensor 92 that is capable of reading data on the media to determine what type of digital cut file is to be used. In embodiments, the data is an information code, such as a 1D or 2D bar code, a 2D QR code, or the like. In some embodiments, the cutting and creasing instructions are resident on the cutting and creasing device and the sensor senses data indicative of the instructions to be used. In embodiments, the sensor is an optical reader, such as an optical scanner.

Figure 6:
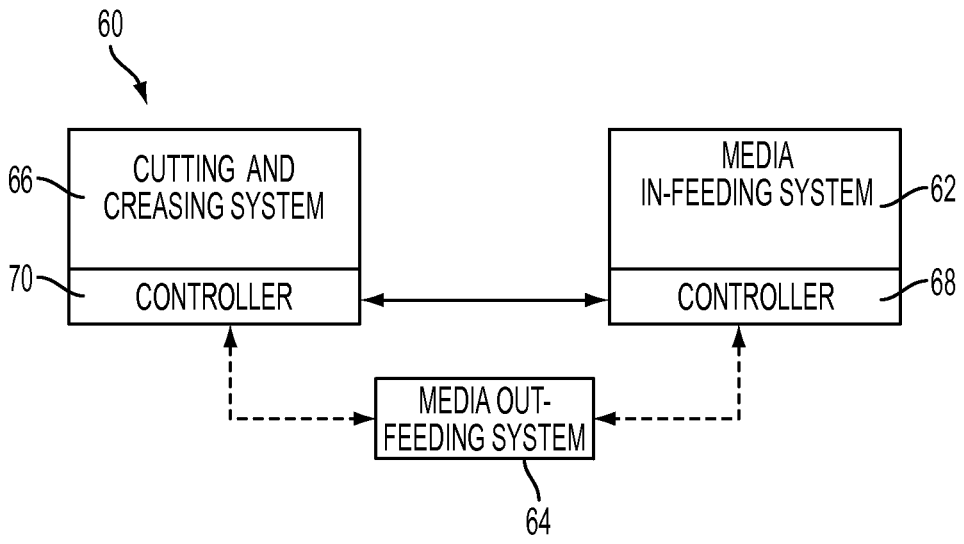
FIG. 6 is a simplified schematic view of a media cutting, creasing and feeding system according to one embodiment.
Figure 7:
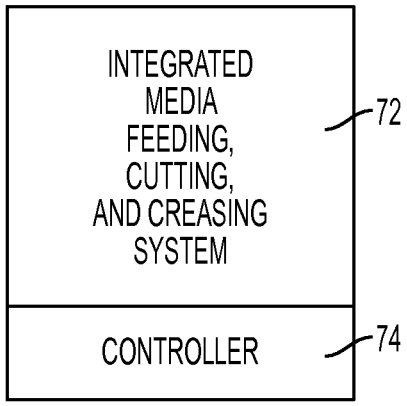
FIG. 7 is a simplified schematic view of a media cutting, creasing and feeding system according to another embodiment.

FIGS. 6-7 show relationships between the cutting and creasing device and the media feeding system in various embodiments. In the embodiment of FIG. 6, the overall media converting system 60 includes a cutting and creasing system 66 which includes a cutting blade and a creasing tip, and a controller 70. The automatic in-feeder includes a media in-feeding system 62 and a controller 68. The media out-feeding system 64, which is part of the automatic out-feeder, can be controlled by the media in-feed controller, the controller for the cutting and creasing device, or a separate controller (not shown). In the embodiment of FIG. 7, an integrated media feeding, cutting and creasing system 72 has a single controller 74.

Figure 8:
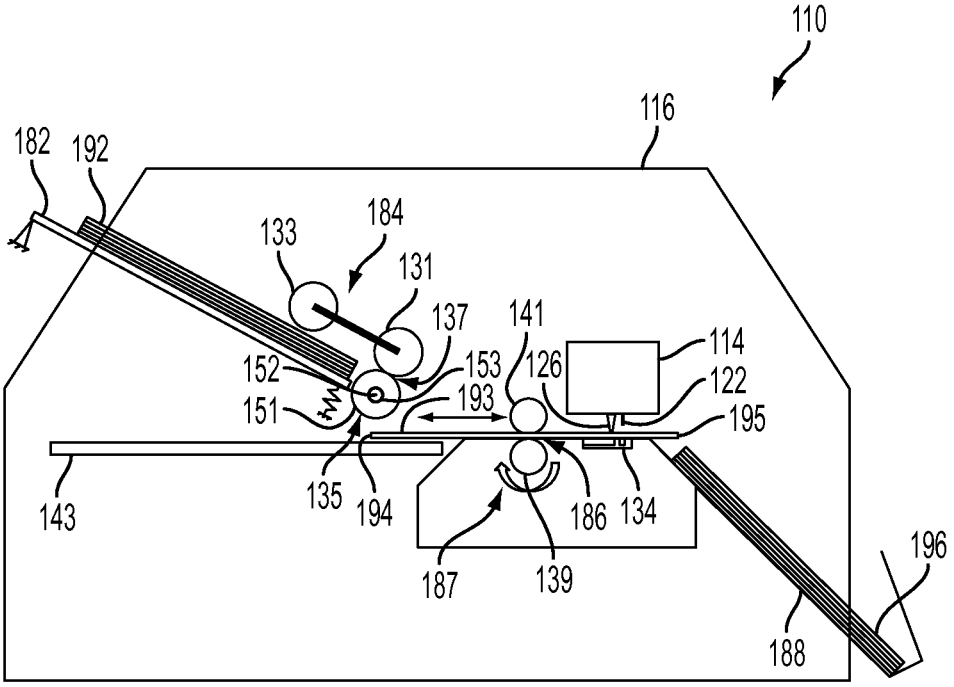
FIG. 8 is a simplified, schematic side view of another embodiment of a media cutting, creasing and feeding system that includes automatic in-feed to, and automatic out-feed from, the cutting and creasing device.

FIG. 8 schematically illustrates an embodiment in which the cutting and creasing system, which is designated generally as 110, includes an in-feed receptacle 182, an automatic in-feeder 184 and a dual surface cutting and creasing platform 134. The system 110 also includes a cutting and creasing head 114 with a cutting blade 122 and a creasing tip 126, a media positioner which also functions as an automatic out-feeder 187, and an output receptacle 188. Portions of the in-feed receptacle 182 and output receptacle 188 are disposed in the housing 116 of the cutting system 110. The in-feed receptacle 182 and the output receptacle 188 are each configured to hold a media stack, shown as an uncut stack 192 and a cut stack 196 of media sheets 193. The automatic in-feeder 184 includes a retard feed assembly 135, and a nudger roll 133 upstream from the retard feed assembly 135. The retard feed assembly 135 includes a drive roll 131 and a retard roll 151 that together form a nip 137 for forwarding the sheets onto the cutting and creasing platform 134. During operation the nudger roll 133 contacts the uppermost sheet of stack 192 from in-feed receptacle 182, and rotates to advance the uppermost sheet from stack 192 into the retard feed assembly 135.

The retard roll 151 includes a cylindrical section 152 that is supported for rotation on a shaft 153. The retard roll facilitates separation of double fed sheets. The details of the "slip clutch" technology used to separate double fed sheets are described in U.S. Pat. No. 5,435,538.

The drive roll 131 and retard roll 151 rotate to move a sheet of media forward through the cutting and creasing device 110 and onto the cutting and creasing platform 134. The cutting and creasing system 110 includes a pair of cutter rolls 139, 141, defining a nip 186 configured to move a sheet 193 of media backward and forward on the cutting and creasing platform 134. More specifically, in embodiments, the sheet 193 is moved though the cutter 116 by the drive roll 131 and retard roll 151 until the leading edge portion of the sheet is picked up by the cutter nip 186. After the leading edge portion 195 of the sheet 193 is disposed between the cutter rolls 139, 141, the trailing edge 194 of the sheet 193 passes out of the retard feed assembly 135. At this point, the trailing edge 194 of the sheet 193 falls downward onto the extension platform 143 that extends upstream from the cutting and creasing platform 134. The sheet 193 continues to be moved along inside the cutting and creasing device 110 using the cutter rolls 139, 141. Once disposed horizontally on the cutting and creasing platform 134, the sheet 193 is registered, cut and/or creased with a digital cutting and creasing device 114 and ejected. Further details of automatic feed devices are provided in U.S. application Ser. No. 13/439,369 filed Apr. 4, 2012, the contents of which are incorporated herein in their entirety.

In the embodiment shown in FIG. 8, the retard feed assembly 135 is disposed in the cutting and creasing device 110 vertically above the upstream section of the cutting and creasing platform 134. In this embodiment, an extension platform 143 extends horizontally in an upstream direction from the upstream side of the cutting and creasing platform inside the cutting and creasing device 110. The trailing edge portion 194 of the sheet 193 is not co-planar with the front edge portion 195 until the sheet 193 is on the cutting and creasing platform 134.

The embodiments of FIGS. 5 and 8 can include data sensors such as identification code scanners that scan data on the top sheet of media in a particular cutting and/or creasing job. This added step of automation further speeds the processing of several different print jobs in sequence that employ media from the same in-feed receptacle. The embodiments of FIGS. 5 and 8 enable automatically fed sheets of media to be both cut and creased using an X-theta type cutter, thereby enabling low volume media converting jobs to be executed at a lower cost than would be incurred if a die cutter or X-Y media cutter were used.

Figure 9:
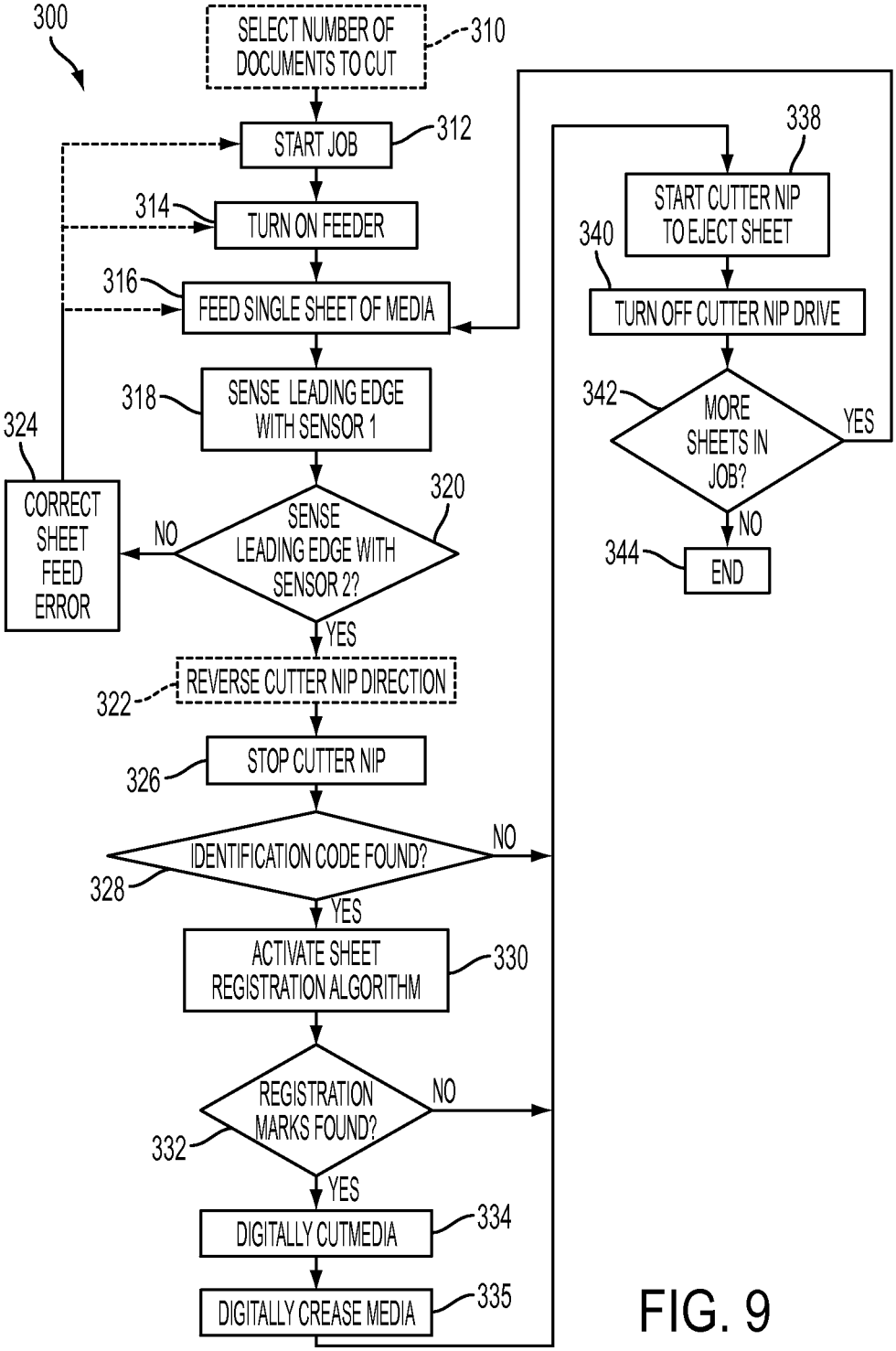
FIG. 9 is a flow diagram describing operation of the media cutting, creasing and feeding systems of FIGS. 7 and 8 in a mode in which a digital cutting and creasing program is automatically selected.
Figure 10:
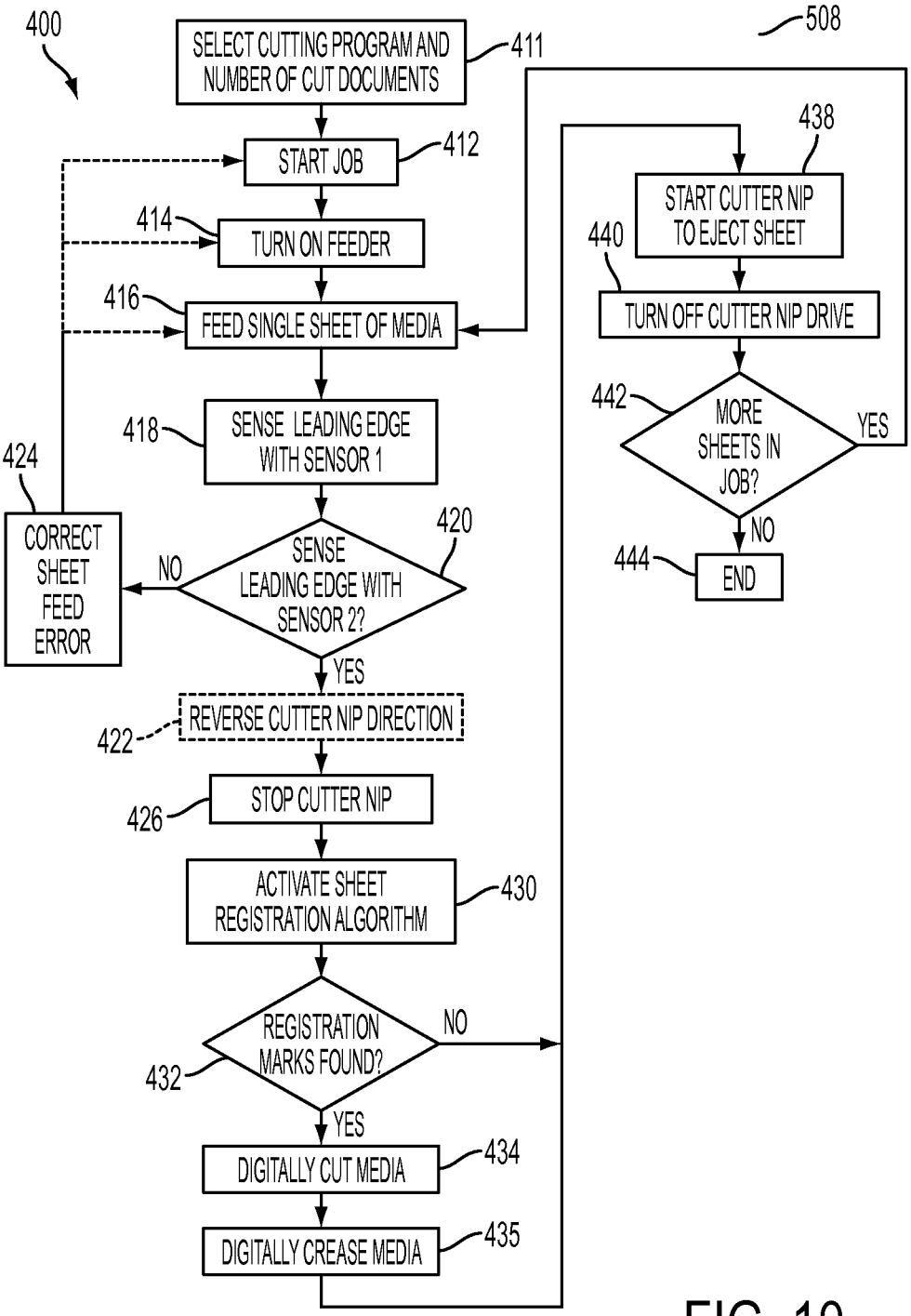
FIG. 10 is a flow diagram describing operation of the media cutting, creasing and feeding systems of FIGS. 7 and 8 in which an operator manually selected a digital cutting and creasing program.

The flowcharts shown in FIGS. 9 and 10 describe operation of the automated media feeding, cutting and creasing system. Automatic mode is shown in FIG. 9 and partially automatic, partially manual mode is described in FIG. 10. Briefly stated, in the automatic method described in FIG. 9, each individual media sheet (or the first sheet in a batch of sheets) has an identification code printed thereon that specifies which program file is to be used for digital cutting and creasing. After the system is turned on, the identification code scanner 92 reads the identification code, such as a barcode, on the media sheet on the top of the stack and sends a signal to the digital cutting and creasing device as to which file should be used for cutting and creasing. The appropriate file is selected and the file is utilized to operate the cutting and creasing tools. When the system is operated in partially manual mode, no identification code scanner is used. An operator identifies the cutting and creasing program to be used and loads the cutting and creasing file located on a host PC (see FIGS. 8-9). This file of cutting and creasing instructions is then sent to the cutting and creasing device, which cuts and/or creases the sheet in accordance with the instructions contained in the cutting and creasing file.

More particularly, as is shown in FIG. 9, the automated process is generally designated at 300. An operator optionally selects the number of documents to be cut and/or creased at 310. (In some embodiments, instead of selecting the number of documents to be processed, the feeder and cutting and creasing device operate until no more identification codes are available to be read on media being fed, or until no more media is present in the in-feed receptacle.) The job is started at 312 by pressing a "start button" or in another manner. The feeder is turned on at 314, resulting in the automatic feeding of a first sheet of media at 316. The feeder often includes a nudger roll and a retard feed assembly. Take-away rolls (if included see U.S. application Ser. No. 13/439,369 filed Apr. 4, 2012) are either turned on with the retard feed system or are activated when the presence of media is sensed. The media is automatically fed, one sheet at a time, using the feeder. While a sheet is moving towards the cutting and creasing device, the sensor 92 (which may be an optical scanner, for example) reads the data on the sheet and sends the corresponding information to the controller. The sheet of media moves forward in the system until its leading edge is sensed with a first sensor at 318. The sheet of media continues to advance until it has passed into the cutter nip and its leading edge is sensed with a second sensor inside the cutting and creasing device at 320. After sensing by the second sensor, the travel direction of the sheets often is reversed at 322. If the second sensor does not sense the sheet, a feed error is assumed to have occurred and the sheet feed error is corrected at 324. The process re-starts with a return to 312, 314 or 316.

If the travel direction of the sheet has been reversed at 322, the sheet travels in the reverse direction until it is properly aligned, according to sheet edge detection via the second sensor. At this point, the cutter nip stops at 326. If an identification code was found to be present, shown at 328, the (previously read) identification code information from the media is used by the controller to determine the proper cutting program to use. (If no identification code was found, the uncut sheet is ejected at 338 into the output receptacle by rotation of the cutter nip in a forward direction.) The controller sends a signal to the cutter as to which cutting and creasing program is to be used to cut and/or crease the media, and the appropriate sheet registration algorithm is activated at 330. After the registration marks are found at 332, the media is digitally cut at 334. (If there is a problem finding the registration marks, a misalignment problem probably occurred and the sheet is ejected at 338.) Once cutting is finished, the cutting tool is retracted and, if creasing is required, the creasing tool is activated and the media is digitally creased at 335. The creasing tool is retracted when creasing is completed.

Once cutting and creasing are finished, the cutter nips are activated at 338 to eject the cut sheet. This action by the cutter nips can be effected, for example, by programming the cutter controller to utilize the cutter nip to feed the cut and/or creased media to the out-feed receptacle. After ejection, the cutter nip can be turned off at 340. A determination is made at 342 as to whether there are more sheets in the job. If so, the process returns to 316. If not, the job ends at 344.

In one variation of the process shown in FIG. 9, the positioning of the sheet in the cutting and creasing device may occur without requiring backward movement. In this case, movement of the sheet usually is stopped by stopping rotation of the cutter nip at 326. In another variation, a different type of feed mechanism is used in the process, for example, vacuum feed technology, especially for feeding the sheets of media into the cutter, and optionally also for moving the sheets within and out of the cutter. In yet another variation, creasing takes place before cutting.

For partially manual operation of the system, as is shown in FIG. 10 and as designated as 400, an operator selects the cutting and creasing program and optionally selects the number of documents to be cut and/or creased at 411 (unless, for example, the number of media sheets in the in-feed receptacle equals the number of sheets to the cut and/or creased). The job is started at 412 by pressing a "start button" or in another manner. The feeder is turned on (often a nudger roll and a retard feed assembly) at 414, resulting in the automatic feeding of a first sheet of media at 416. Take-away rolls (if included) are either turned on with the retard feed system or are activated when the presence of media is sensed. The media is automatically fed, one sheet at a time, using the nips of the retard feeder and take-away rolls. The sheet of media moves forward in the system until its leading edge is sensed with a first sensor at 418. The sheet of media continues to advance until it has passed the cutter nip and its leading edge is sensed with a second sensor inside the cutting and creasing device at 420. After sensing by the second sensor, the travel direction of the sheets often is reversed at 422. If the second sensor does not sense the sheet, a feed error is assumed to have occurred and the sheet feed error is corrected at 424. The process re-starts with a return to 412, 414 or 416.

After the travel direction of the sheet is reversed at 422, the sheet travels in the reverse direction until it is properly aligned, according to sheet edge detection via the second sensor. At this point, the cutter nip stops at 426. The appropriate sheet registration algorithm is activated at 430 based on the cutting program that was selected at 411. After the registration marks are found at 432, the media is digitally cut at 434. If there is a problem finding the registration marks, a misalignment problem probably occurred and the sheet is ejected at 438.

Once cutting is finished, the cutting blade is retracted and the media is digitally creased at 435, if creasing is required. After creasing is finished, the creasing tool is retracted and the cutter nips are activated at 438 to eject the cut sheet. After ejection, the cutter nip can be turned off at 440. A determination is made at 442 as to whether there are more sheets in the job. If so, the process returns to 416. If not, the job ends at 444.

In one variation of the process shown in FIG. 10, the positioning of the sheet in the cutting and creasing device may occur without requiring backward movement. In this case, movement of the sheet usually is stopped by stopping rotation of the cutter nip at 426. In another variation, a different type of feed mechanism is used in the process, for example, vacuum feed technology, especially for feeding the sheets of media into the cutter, and optionally also for moving the sheets within and out of the cutting and creasing device. In yet another variation, creasing takes place before cutting.

Figure 11:
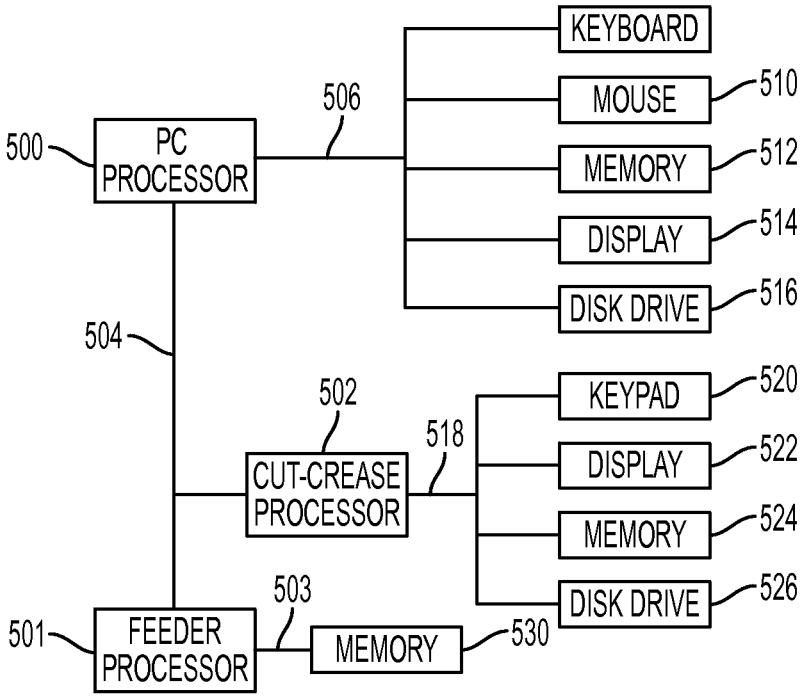
FIG. 11 is a block diagram of an exemplary system that can be used to contain or implement program instructions for the embodiment of FIG. 6.
Figure 12:
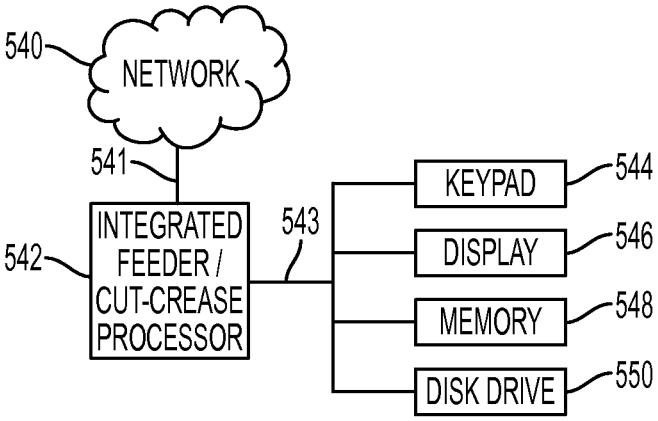
FIG. 12 is a block diagram of an exemplary system that can be used to contain or implement program instructions for the embodiment of FIG. 7.

FIGS. 11-12 depict non-limiting examples of computer systems that can be used to implement program instructions for use with the feeding, cutting and creasing systems shown in FIGS. 1-10. In FIG. 11, which corresponds to certain embodiments of the system of FIG. 6, a PC processor 500, a cut-crease processor 502, which handles both cutting and creasing, and a feeder processor 501 are interconnected by a bus or other data transfer subsystem 504. A bus or other data transfer subsystem 506 interconnects the PC processor 500 with the other system components, including a keyboard 508, which may be in the form of a physical keyboard and/or a touch screen, a mouse 510, a memory 512, a display 514 and one or more disk drives 516 of various types. A bus or other data transfer subsystem 518 interconnects the cut-crease processor 502 with the other system components, including a keypad 520, which may be in the form of a physical keypad and/or a touch screen, a display 522, a memory 524 and one or more disk drives 526 of various types. A bus or other data transfer subsystem 503 interconnects the feeder processor 501 with memory 530. Media can be removed from the cutting and creasing device using the cut-crease processor 502 or the feeder processor 501. In FIG. 12, which corresponds to the system of FIG. 7, a processor for integrated feeding, cutting and creasing 542 is interconnected by a bus or other data transfer subsystem 543 to the other system components, including a keypad 544, which may be in the form of a physical keypad and/or a touch screen, a display 546, a memory 548 and one or more disk drives 550 of various types. The processor 542 is also connected to a network 540 via a data bus 541. The electronic connections shown in the figures can be hard-wired or wireless depending on the technology selected and available for use.

A non-limiting example of feed technology that can be adapted for use with this system is Xerox® retard feed technology, which can be incorporated into an adapted version of a by-pass feeder used in a multifunction printing device.

Typical systems occupy a floor footprint in the range of 8-25 square feet, or 10-18 square feet, or 10-15 square feet, enabling the system to be used in small print shops. The volume occupied by the system typically is in the range of 20-100 cubic feet, or 20-60 cubic feet, or 20-40 cubic feet.

As indicated above, the system enables a print shop to produce low cost dimensional documents for low volume print jobs in an economically competitive manner. The system and method are particularly well suited for use in low volume and short run packaging applications ranging from 2 to 500 pieces. Print jobs in the range of 1-500, or 1-250 or 1-100 are well suited for cutting using the system and method described. The embodiments shown in FIGS. 1-12 are particularly well-suited to cut and crease at processing rates in the range of 5-60 sheets of media per hour, or 10-45 sheets per hour, or 15-30 sheets per hour depending on the complexity of the cutting performed.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims. Unless specifically defined in a specific claim itself, steps or components of the invention should not be implied or imported from any above example as limitations to any particular order, number, position, size, shape, angle, color, or material.

What is claimed is:

1. An apparatus comprising:

a cutting and creasing tool configured to move in an X direction but not in a Y direction during use, the cutting and creasing tool including a cut-crease head comprising a non-rotatable cutting blade with a cutting edge and a terminal end, the cutting blade being moveable between an engaged position in which the terminal end is below a sheet of media and a non-engaged position in which the terminal end is above the sheet of media, and a non-rotatable creasing tip spaced from the cutting blade, the cut-crease head being configured to support only one cutting blade and only one creasing tip during use, a cutting and creasing platform having a generally planar upper surface configured to support the sheet of media during cutting and creasing, the platform including an elastically deformable creasing portion disposed beneath the creasing tip, and a non-deformable cutting portion disposed adjacent to the creasing portion and beneath the cutting blade, the cutting portion having an elongated channel formed therein to receive the cutting blade when the cutting blade is in the engaged position, a positioner configured to draw the sheet of media along the cutting and creasing platform in a Y-direction while shifting the sheet back and forth along the Y-direction in response to at least one of a cutting order and a creasing order, and a computerized processor configured to operate the cutting and creasing tool and the positioner.

2. The apparatus of claim 1, further including an automatic media feeder configured to automatically feed sheets of media onto and off of the cutting and creasing platform.

3. The apparatus of claim 1, wherein the cutting blade and creasing tip are operated using solenoids.

4. The apparatus of claim 1, wherein the creasing portion has a Shore A hardness in the range of 40-90.

5. The apparatus of claim 1, wherein the creasing portion is upstream from the cutting portion.

6. The apparatus of claim 1, wherein the cutting portion of the cutting and creasing platform has a plurality of elongated channels formed therein.

7. The apparatus of claim 1, wherein the cutting portion comprises metal.

8. The apparatus of claim 1, wherein the cutting portion includes a removable segment comprising a plurality of walls defining the channel portion.

9. The apparatus of claim 1, wherein the creasing portion of the cutting and creasing platform comprises a thermoplastic or thermoset material.

10. The apparatus of claim 1, further comprising a sensor configured to read data on the sheet of media comprising instructions for at least one of cutting and creasing.

11. A system comprising:

a cutting and creasing tool configured to move in an X direction but not in a Y direction during use, the cutting and creasing tool including a cut-crease head comprising a non-rotatable cutting blade with a cutting edge and a terminal end, the cutting blade being moveable between an engaged position in which the terminal end is below a sheet of media and a non-engaged position in which the terminal end is above the sheet of media, and a non-rotatable creasing tip spaced from the cutting blade, a cutting and creasing platform having a generally planar upper surface configured to support the sheet of media during cutting and creasing, the platform including an elastically deformable creasing portion disposed beneath the creasing tip, and a non-deformable cutting portion disposed adjacent to the creasing portion and beneath the cutting blade, the cutting portion having an elongated channel formed therein to receive the cutting blade when the cutting blade is in the engaged position, a positioner configured to draw the sheet of media along the cutting and creasing platform in a Y-direction while shifting the sheet back and forth along the Y-direction in response to at least one of a cutting order and a creasing order, a sensor configured to read data on the sheet of media comprising instructions for at least one of cutting and creasing, a computerized processor configured to operate the cutting and creasing tool, the sensor and the positioner, a first feeder disposed adjacent to or connected to the cutting and creasing platform, the first feeder being configured to automatically transport individual sheets of media from an in-feed receptacle toward the cutting and creasing platform using a first feed device, and a second feeder disposed adjacent to or connected to the cutting and creasing platform, the second feeder being configured to automatically transport individual sheets of media from the cutting and creasing platform to an out-feed receptacle after at least one of cutting and creasing.

12. The system of claim 11, wherein the creasing portion is upstream from the cutting portion.

13. The system of claim 11, wherein the cutting portion includes a removable segment comprising a plurality of walls defining the channel portion.

14. A method of making a media converter, comprising:

forming a cutting and creasing tool configured to move in an X direction but not in a Y direction during use, the cutting and creasing tool including a cut-crease head comprising a non-rotatable cutting blade with a cutting edge and a terminal end, the cutting blade being moveable between an engaged position in which the terminal end is below a sheet of media and a non-engaged position in which the terminal end is above the sheet of media, a non-rotatable creasing tip spaced from the cutting blade, and a sensor configured to read data on a sheet of media comprising instructions for at least one of cutting and creasing, forming a cutting and creasing platform having a generally planar upper surface configured to support the sheet of media during cutting and creasing, the platform including an elastically deformable creasing portion disposed beneath the creasing tip, and a non-deformable cutting portion disposed adjacent to the creasing portion and beneath the cutting blade, the cutting portion having an elongated channel formed therein to receive the cutting blade when the cutting blade is in the engaged position, mounting the cutting and creasing tool above the cutting and creasing platform, forming a positioner configured to draw the sheet of media along the cutting and creasing platform in a Y-direction while shifting the sheet back and forth along the Y-direction in response to at least one of a cutting order and a creasing order, and forming a computerized processor to operate the cutting and creasing tool and the positioner.

15. The method of claim 14, further comprising:

forming an automatic first feeder that includes a first feed device to place the sheet of media on the cutting and creasing platform, and forming an automatic second feeder that includes a second feed device to automatically remove the sheet of media from the cutting and creasing platform after cutting and creasing using a second feeder.

16. The method of claim 14, wherein the positioner and the automatic second feeder both use a first roller nip to move the sheet of media in the Y direction.

* * * * *